US010421183B2

(12) United States Patent
Firth et al.

(10) Patent No.: US 10,421,183 B2
(45) Date of Patent: Sep. 24, 2019

(54) APPARATUS FOR USE WITH POWER TOOLS

(71) Applicant: POWER BOX AG, Zug (CH)

(72) Inventors: Robert Firth, York North Yorkshire (GB); Marcus Nicholson, York North Yorkshire (GB)

(73) Assignee: POWER BOX AG, Zug (CH)

( * ) Notice: Subject to any disclaimer, the term of this patent is extended or adjusted under 35 U.S.C. 154(b) by 0 days.

(21) Appl. No.: 14/414,690

(22) PCT Filed: Mar. 6, 2014

(86) PCT No.: PCT/GB2014/050662
§ 371 (c)(1),
(2) Date: Jan. 13, 2015

(87) PCT Pub. No.: WO2014/117830
PCT Pub. Date: Nov. 6, 2014

(65) Prior Publication Data

US 2015/0174756 A1 Jun. 25, 2015

(30) Foreign Application Priority Data

May 2, 2013 (GB) ..... 1307935.5

(51) Int. Cl.

| | |
|---|---|
| ***B25H 1/10*** | (2006.01) |
| ***B25H 1/04*** | (2006.01) |
| ***B25H 1/16*** | (2006.01) |
| ***B25H 1/14*** | (2006.01) |
| ***B25H 1/08*** | (2006.01) |

(52) U.S. Cl.
CPC ..... *B25H 1/10* (2013.01); *B25H 1/04* (2013.01); *B25H 1/08* (2013.01); *B25H 1/14* (2013.01); *B25H 1/16* (2013.01); *Y10T 83/7722* (2015.04)

(58) Field of Classification Search
CPC ... B25H 1/04; B25H 1/08; B25H 1/10; B25H 1/14; B25H 1/16; Y10T 83/7722
USPC ..... 269/136
See application file for complete search history.

(56) References Cited

U.S. PATENT DOCUMENTS

| | | | |
|---|---|---|---|
| 161,304 A | 3/1875 | Wagoner | |
| 208,912 A | 10/1878 | Lambie | |
| 1,120,702 A | 12/1914 | Erdman | |

(Continued)

FOREIGN PATENT DOCUMENTS

| | | | | |
|---|---|---|---|---|
| EP | 0908277 A2 * | 4/1999 | ..... | B25H 1/005 |
| GB | 2353494 A | 2/2001 | | |

*Primary Examiner* — Joseph J Hail
*Assistant Examiner* — J Stephen Taylor
(74) *Attorney, Agent, or Firm* — Volpe and Koenig, P.C.

(57) ABSTRACT

The invention relates to apparatus (2) for use with one or a number of modules (71, 74, 78, 86) comprising a base (60) with, or for the receipt of a power tool (72, 76, 80,88). The module base (60) is received in a recess, aperture (14) or slot defined in a frame (12). Engagement means (68) are provided to allow the module (71, 74, 78, 86) to be releasably engaged in position, guide means (142) to allow the accurate introduction and removal of the module (71, 74, 78, 86) from the frame (12) and adjustment means (61) to allow the position of the base (60) of the module (71, 74, 78, 86), and typically the top surface (66) of the same, to be adjusted with respect to the frame (12) and typically the top surface (64) of the frame (12).

26 Claims, 21 Drawing Sheets

(56) References Cited

Figure 1:
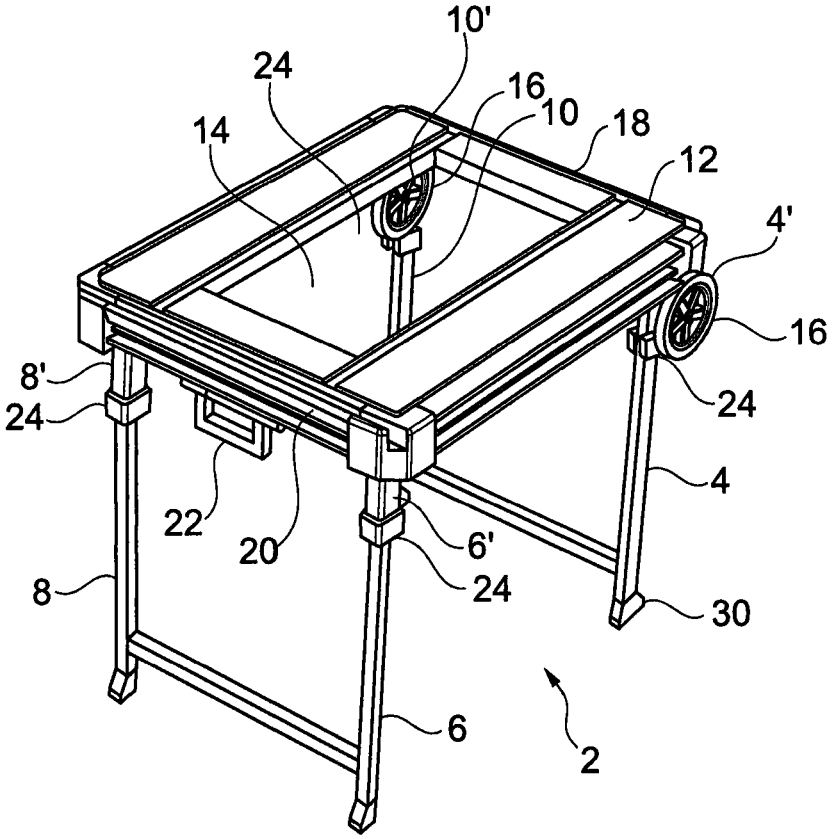

U.S. PATENT DOCUMENTS 1,959,950 A 5/1934 Friedlander
2,144,049 A 1/1939 Forcier
2,202,318 A 5/1940 Ralson
2,291,967 A 8/1942 Keahey
2,660,497 A 11/1953 Norquist
2,708,145 A 5/1955 Anderson
2,879,119 A 3/1959 Bollock
2,977,169 A 3/1961 Geller
3,669,031 A 6/1972 Cole
4,022,414 A 5/1977 Egger
4,103,626 A 8/1978 Barricks
4,144,822 A 3/1979 Roberts
4,483,573 A 11/1984 Keller
4,599,927 A * 7/1986 Eccardt ..... B23D 45/068 83/473
4,833,998 A 5/1989 Everett
5,004,029 A 4/1991 Garner
5,009,170 A 4/1991 Spehar
5,159,864 A 11/1992 Wedemeyer
5,174,349 A * 12/1992 Svetlik ..... B23D 47/025 144/286.1
5,524,555 A 6/1996 Fanuzzi
5,606,922 A 3/1997 Adams
5,819,671 A * 10/1998 Ocampo ..... B23D 47/025 108/19
5,863,052 A 1/1999 Roman
6,058,990 A * 5/2000 Kent ..... B25H 1/10 144/1.1
6,360,797 B1 3/2002 Brazell
6,394,005 B1 5/2002 Isensee
6,865,985 B2 3/2005 Zheng
6,899,004 B1 * 5/2005 Miller ..... B27B 27/02 144/253.1
6,942,229 B2 9/2005 Brazell
7,059,616 B2 6/2006 Wu
7,077,421 B2 7/2006 Wu
7,131,364 B2 11/2006 Brazell
7,213,829 B2 5/2007 Wu
7,222,865 B2 5/2007 Chen
7,418,907 B2 9/2008 Haimoff
7,647,956 B1 * 1/2010 Cona ..... B25H 1/12 144/286.5
D732,247 S 6/2015 Reid
9,403,224 B1 8/2016 Silva
2002/0195028 A1 12/2002 Shieh
2005/0280228 A1 * 12/2005 Fernandes ..... B25H 1/00 280/47.35
2006/0130718 A1 6/2006 Lo
2008/0083106 A1 * 4/2008 Elsworthy ..... B23D 47/025 29/26 A
2008/0210337 A1 9/2008 Sommerville
2008/0308016 A1 12/2008 Meyer
2010/0051137 A1 3/2010 Layton
2011/0232805 A1 9/2011 Despain
2012/0318940 A1 12/2012 Chen

* cited by examiner

APPARATUS FOR USE WITH POWER TOOLS

The invention to which this application relates apparatus which can be used in conjunction with one or more power tools and/or components therefore, in order to allow the power tools to be used in a convenient location and/or in a format and/or environment with which the user of the apparatus is familiar and can operate the power tools safely.

There are many different power tool types which are available and, most commonly, the power tool is purchased and then used as an independent entity and which therefore often requires jigs, guides, support tables and the like to be provided and used in a manner which is specific to each power tool. This can be problematic and frustrating to the user of the tools especially if they use different types of power tools and therefore have to change locations and/or other components in order to use the same. This can also be problematic where the space which is available to use the same is limited.

It is known to attempt to overcome this problem by providing apparatus in the form of a table or bench in relation to which a range of different power tool types can be fitted and used therewith. While these known forms of apparatus can be useful, they can, in certain examples, be little more than a metal frame onto which an extensive number of components have to be fitted and engaged in order to adapt the same for use with a particular form of power tool or, in other instance, can require relatively complex fitting and fixing arrangements which means that while, in theory, the apparatus should be useful, in practice, the apparatus is not used, or underused, due to the time required to adapt the same for a particular purpose.

The aim of the present invention is to provide apparatus which can be used with a number of different types of power tools in order to improve the use of the same and allow the different tools to be used with the apparatus in a common format. A further aim is to allow the apparatus to be adapted for use with different power tools relatively quickly and efficiently and thereby mean that the apparatus is more likely to be used in practice with the different power tool types.

In a first aspect of the invention there is provided apparatus for use with one or more types of power tool to perform a power tool operation on a workpiece, said apparatus comprising a frame defining a slot, recess or aperture in which can be selectively received a module including a base for the reception of and/or carrying at least one power tool thereon and wherein said base is received in said slot, recess or aperture and engaged with the frame to secure the module in position, to thereby form, in combination, a work surface on which the workpiece is positioned during the operation of the power tool.

In one embodiment the apparatus includes engagement means to lock the module in position with the frame.

Typically the engagement means includes a first portion located on the frame and a second portion located on the base.

Typically the first portion includes a part which is movable between an engaging position in which the same protrudes into contact with the second portion and a release position.

Typically the engagement means is biased towards the lower surface of the frame. Preferably when the part is in the engaging position it acts to bias the module base to retain contact between adjustment means provided on the base and frame.

Typically the said part can be latched in either or both of the engaging and/or release positions.

Typically, a plurality of modules are provided and which can be selectively positioned in the slot, recess or aperture in the frame. In one embodiment at least one of the modules is provided such that the same can be used independently of the frame of the apparatus.

Typically the external dimensions of the base of each of the modules and/or the means for engagement of the modules with the apparatus is common between said modules.

In one embodiment the power tool carried or received by the module is operable to perform the operation on the workpiece when the module is engaged with the frame.

Typically the module and/or frame includes adjustment means to allow the level of the top surface of the base of the module to be adjusted with respect to the frame. In one embodiment the adjustment means, once set after initial alteration, are retained in the adjusted position such that when the module is thereafter placed into position, the level of the top surface of the module base with respect to the level of the frame top surface is at the same position as when adjustment was initially performed.

In one embodiment the adjustment made is to bring the top surface of the base of the module substantially in line with the top surface of the frame so as to form a substantially uniform work surface. Typically the adjustment means are provided at spaced locations on the module base and are movable with respect to an adjacent portion of the frame to allow relative adjustment at each said location.

Preferably the adjustment means are actuable by a user from the top surface of the module base.

In one embodiment the adjustment means include a first set comprising a first member provided on the base, a second member engaging with the first member and located on the frame and a user actuation means which, when operated, causes relative movement between the first and second members. In one embodiment a plurality of said sets are provided which are spaced apart.

In one embodiment the said sets also assist in guiding the movement of the position of the base into and from the frame.

In one embodiment the adjustment means includes a series of user actuation means each of which, contact with a support means extending from the frame and which causes the base and hence the level of the top surface of the same to be adjusted with respect to the frame.

Typically guide means are provided to allow the guided introduction and/or removal of the module into and/or from the slot, recess or aperture in the frame.

In one embodiment the guide means are located at or adjacent to one end of the module and on opposing sides thereof.

In one embodiment the guide means comprise a member provided on one of the base and frame and a shaped ramp portion provided on the other of the base or frame and along which the protruding member moves.

In one embodiment the member protrudes from an edge of the base and the shaped ramp portion is provided inwardly of the edge of the slot, recess or aperture of the frame.

Typically a plurality of modules can be selectively positioned in the slot, recess or aperture with the module provided with a power tool which can be operated when the module is in position.

In one embodiment the adjustment means include a plurality of threaded members such as grub screws provided at spaced locations on the module base and the same depend downwardly below the base by a selected distance in order to provide the required position of the top surface of the base.

Typically the engagement means are provided with a latch which retains the movable portion in one of the locking or released position and the movement to the locking position acts to move the module into a fixed position.

In one embodiment the module, once in position with the frame can be movable with respect to the frame so as to allow access and/or setting of at least one feature of operation of the power tool which is provided with that module.

In one embodiment the power tool is located on the underside of the base with apportion protruding through the base to the top surface. In one embodiment a range of movement is provided to allow the extent to which a cutting blade protrudes above the top surface of the base of the module to which the power tool is fitted.

In another embodiment the power tool is mounted on or above the top surface of the base of the module. In one embodiment one or more guide rails can be provided and located on the frame and or module and with which the power tool is mounted directly or indirectly to allow guided movement thereof. In one embodiment the height of the one or more guide rails with respect to the top surface of the module base and/or frame can be user adjusted so as to define the height of the power tool above the module base and/or frame.

Typically the frame is provided with at least one portion which is selectively movable to a position within a range of positions to a side of the frame in order to allow the selective increase or decrease of the effective area of the top surface of the frame. In one embodiment said portion can be selectively moved to either side of the frame.

In one embodiment the said frame portion is provided with one or more locating means, such as a plurality of apertures, for power tools and/or associated components, formed therein. In one embodiment one of the modules comprises a base with a plurality of locating means formed therein such that the base and frame portion can, in combination, provide a wide range of user selectable location means.

In one embodiment the frame includes a plurality of support legs, said support legs, in a first extended embodiment, positioning the top surface of the frame at a first distance from a support surface on which the legs are located and, in a second embodiment in which a portion of the same are folded or retracted, and the top surface of the frame is positioned at a spaced distance from the support surface which is less than when the legs are in the first embodiment.

In one embodiment the frame includes a first set of wheels, castors or rollers which allow movement of the apparatus in a first form and a second set of wheels, castors or rollers which allow movement of the apparatus in a second form.

In one embodiment the top surface of the frame includes one or more guiderails to allow the selective engagement with components to be used on the frame and the guided movement and positioning of the same. In one embodiment a fence is provided for the positioning and/or guided movement of a workpiece on which work is being performed.

In one embodiment the power tools for which respective modules are provided include any or any combination of a router, circular saw, flooring saw, band saw, project saw and/or a table saw and/or a clamping base and/or a sander and/or a jigsaw and/or a vacuum base and/or a biscuit jointer and/or a finger jointer.

With certain power tools the majority of the power tool body is located on the underside of the module base with the working portion of the same protruding through and from the top surface of the base. For other power tools the majority of the power tool body is located above the module base.

Typically, for those power tools in which the body is mounted on the underside of the module base, then if the power tool requires to be adjusted with respect to the base of the module and/or the frame the adjustment can be achieved by the user from the top surface of the apparatus.

In one embodiment the said adjustment can be achieved through the user passing their hand through one or more apertures provided in the base and/or via one or more adjustment mechanisms which have an actuation means mounted on the upper side of the base and which pass through to contact and adjust the power tool on the underside of the base and with which the power tool is aligned when the same is located on the base to form the module.

In one embodiment the frame includes at least one elongate engagement formation along an edge of the same said engagement formation allowing the receipt of one or more components thereon. In one embodiment the said component is a power socket housing so as to allow power to be supplied to the frame and the selective connection of the power to the power tools therefrom.

Figure 2A:
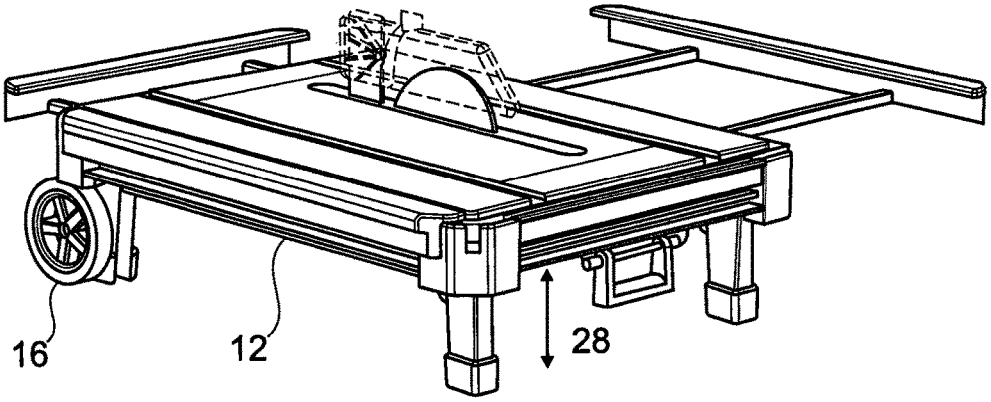
Figure 2B:
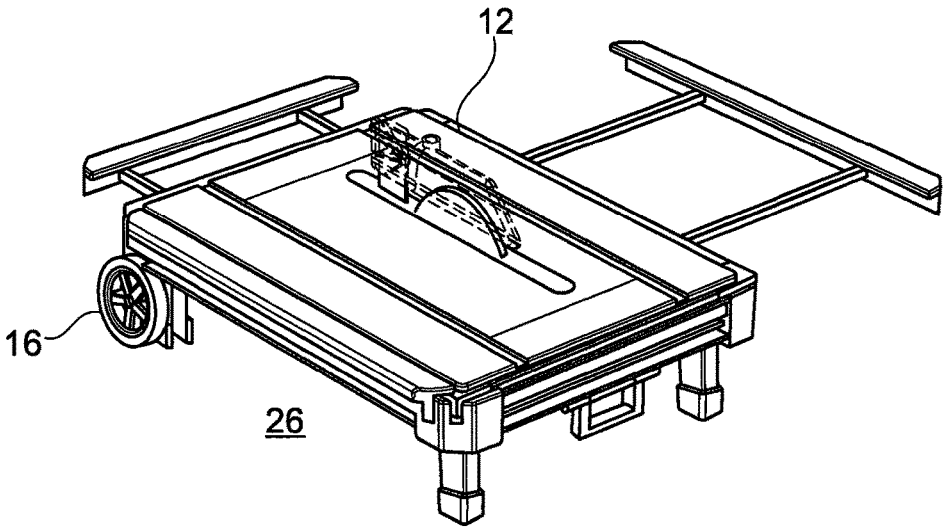
Figure 3A:
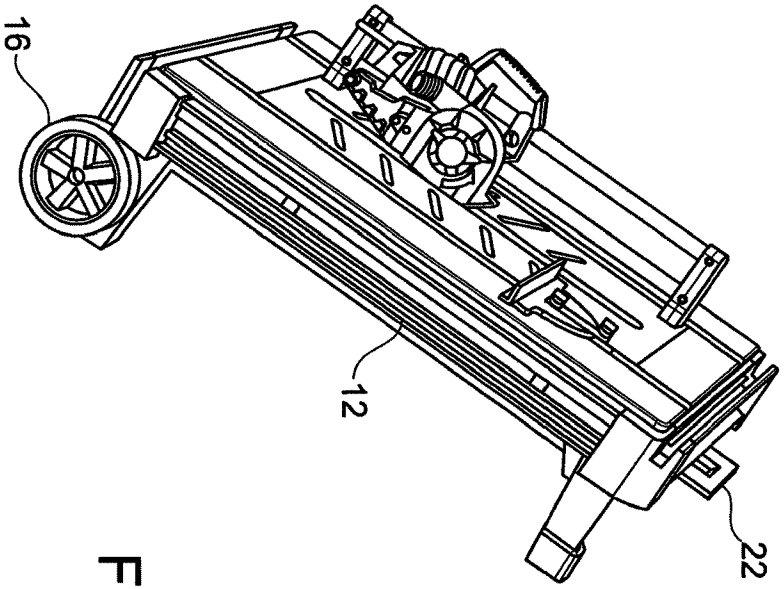
Figure 3B:
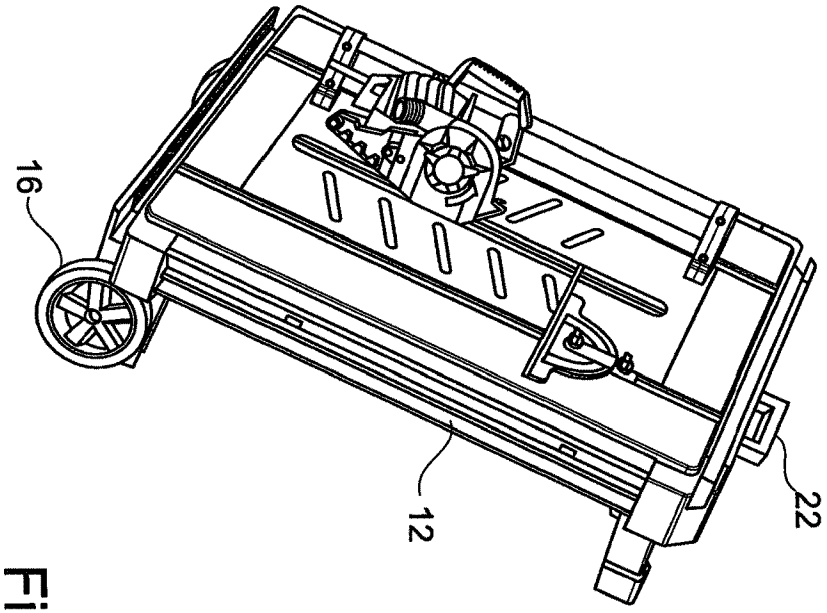
Figure 4A:
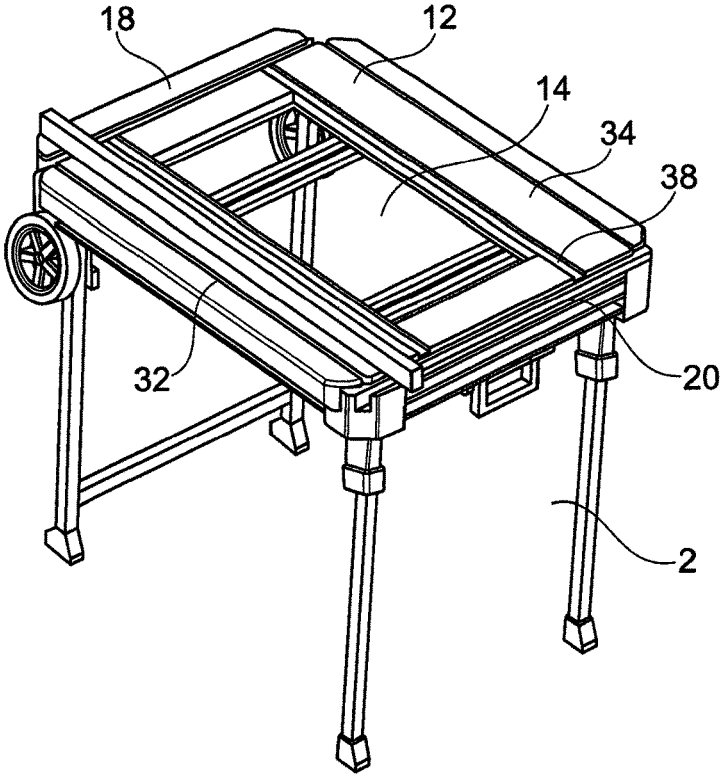
Figure 4B:
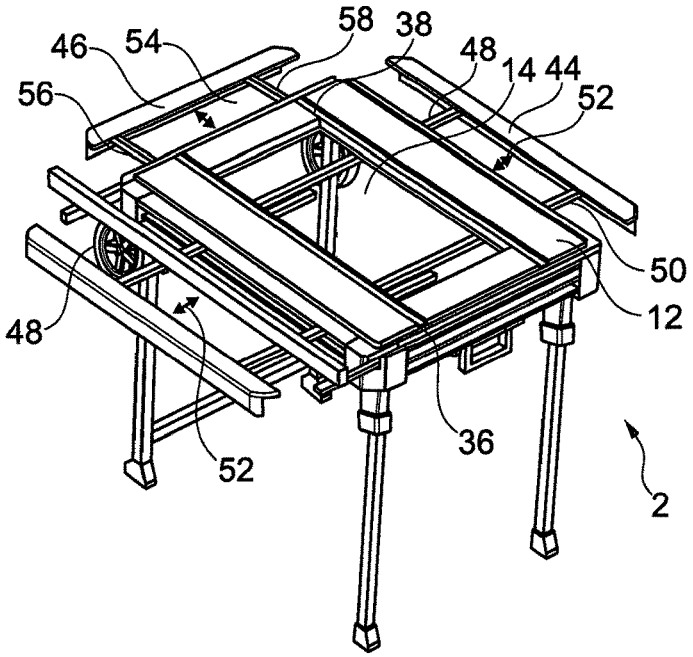
Figure 5:
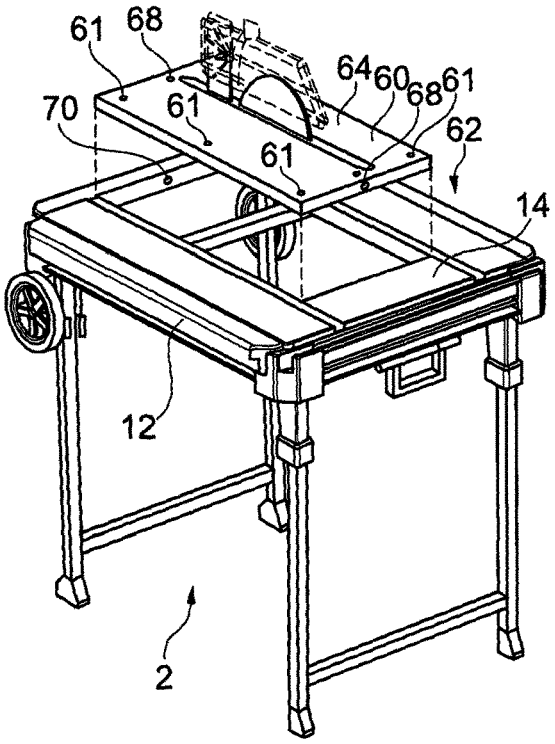

Specific embodiments of the invention are now described with reference to the accompanying drawings; wherein FIG. 1 illustrates apparatus in accordance with one embodiment of the invention in a first condition;

FIGS. 2*a* and *b* illustrate the apparatus of FIG. 1 in a second condition;

FIGS. 3*a* and *b* illustrate the apparatus of FIGS. 1 and 2*a* and *b* in a transport mode;

FIGS. 4*a* and *b* illustrate the manner in which the apparatus frame can be altered;

FIG. 5 illustrates the positioning of a power tool with the frame of the apparatus of FIGS. 1-4*b;*

Figure 7A:
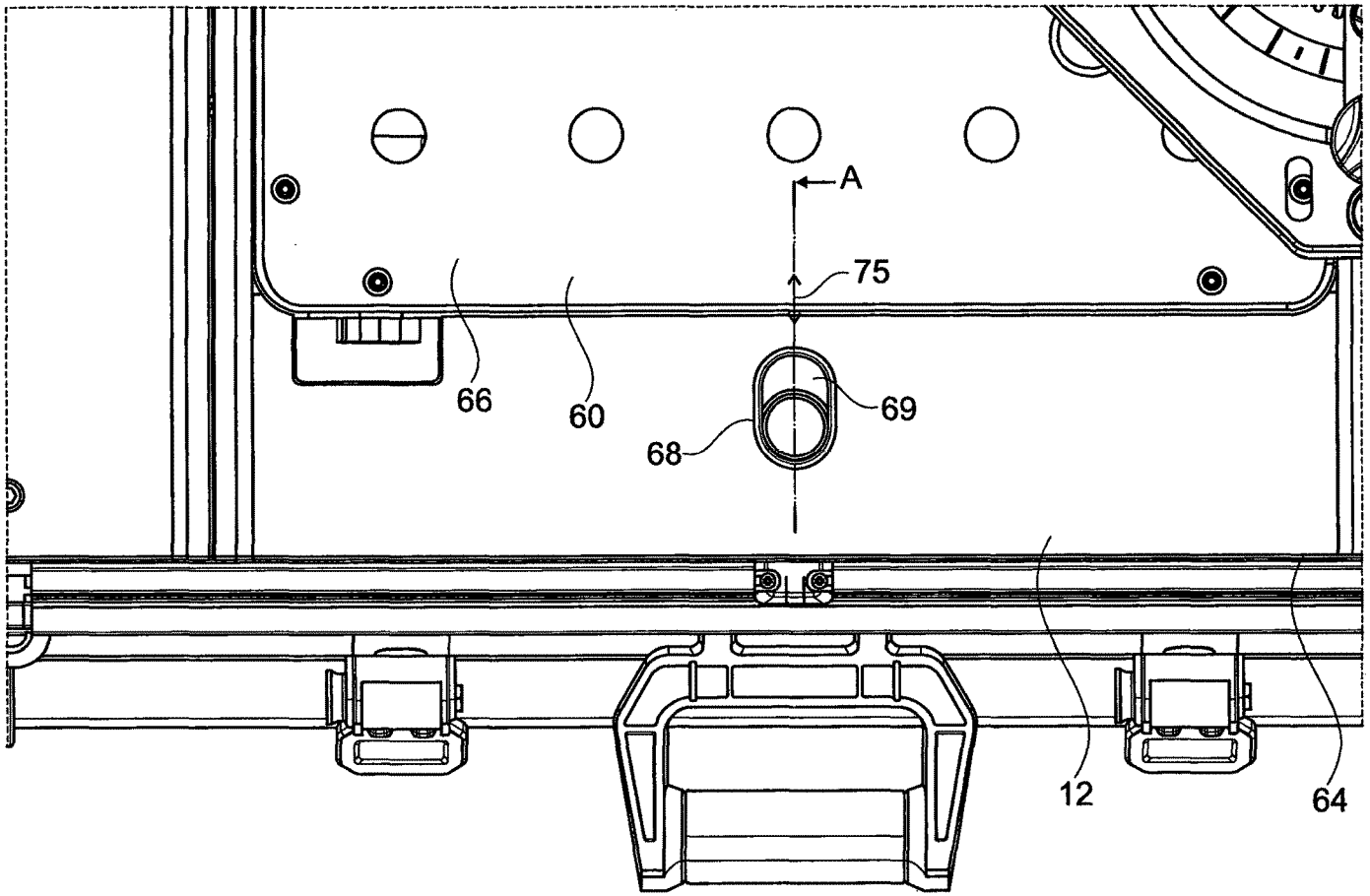
Figure 7B:
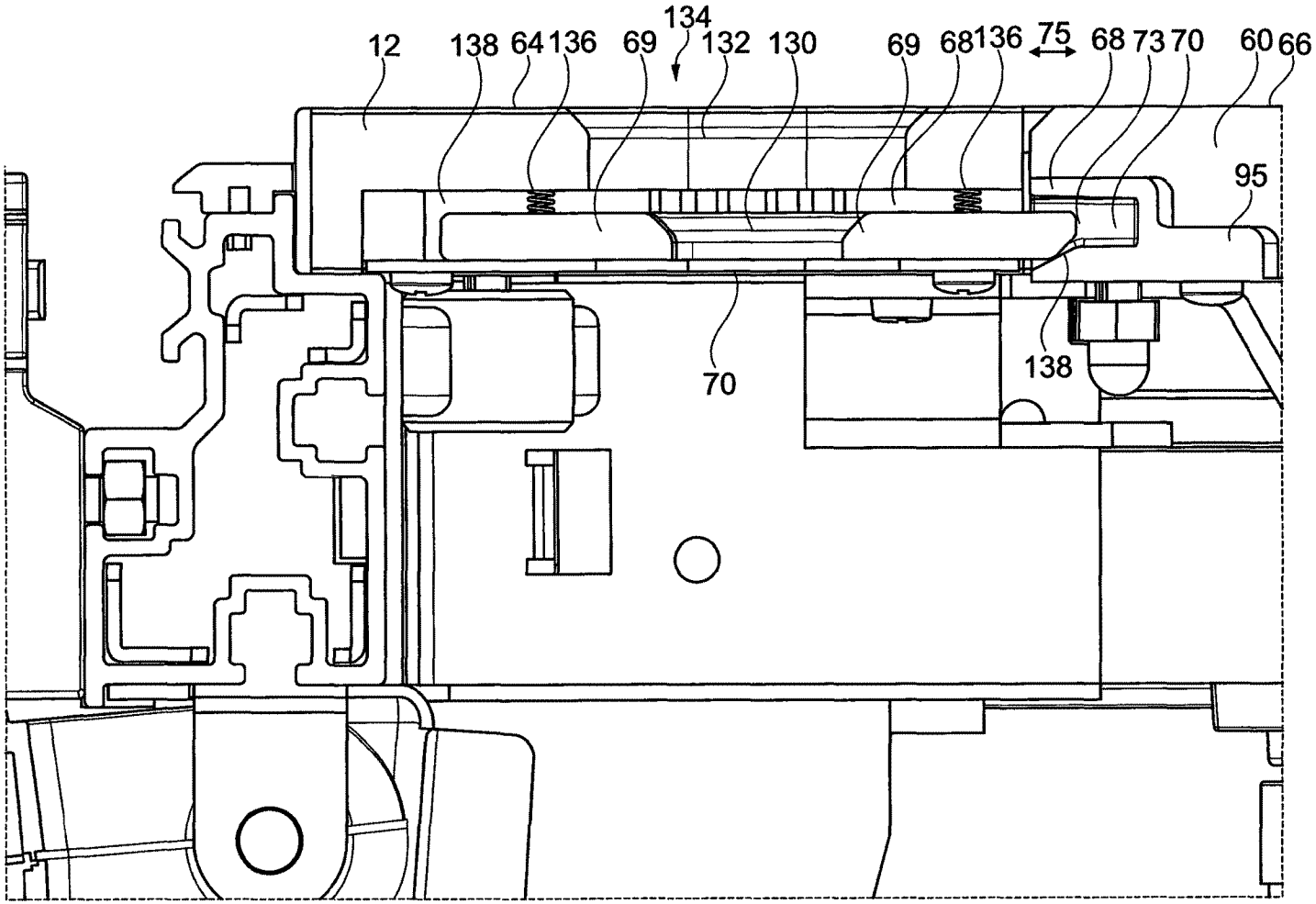
Figure 7C:
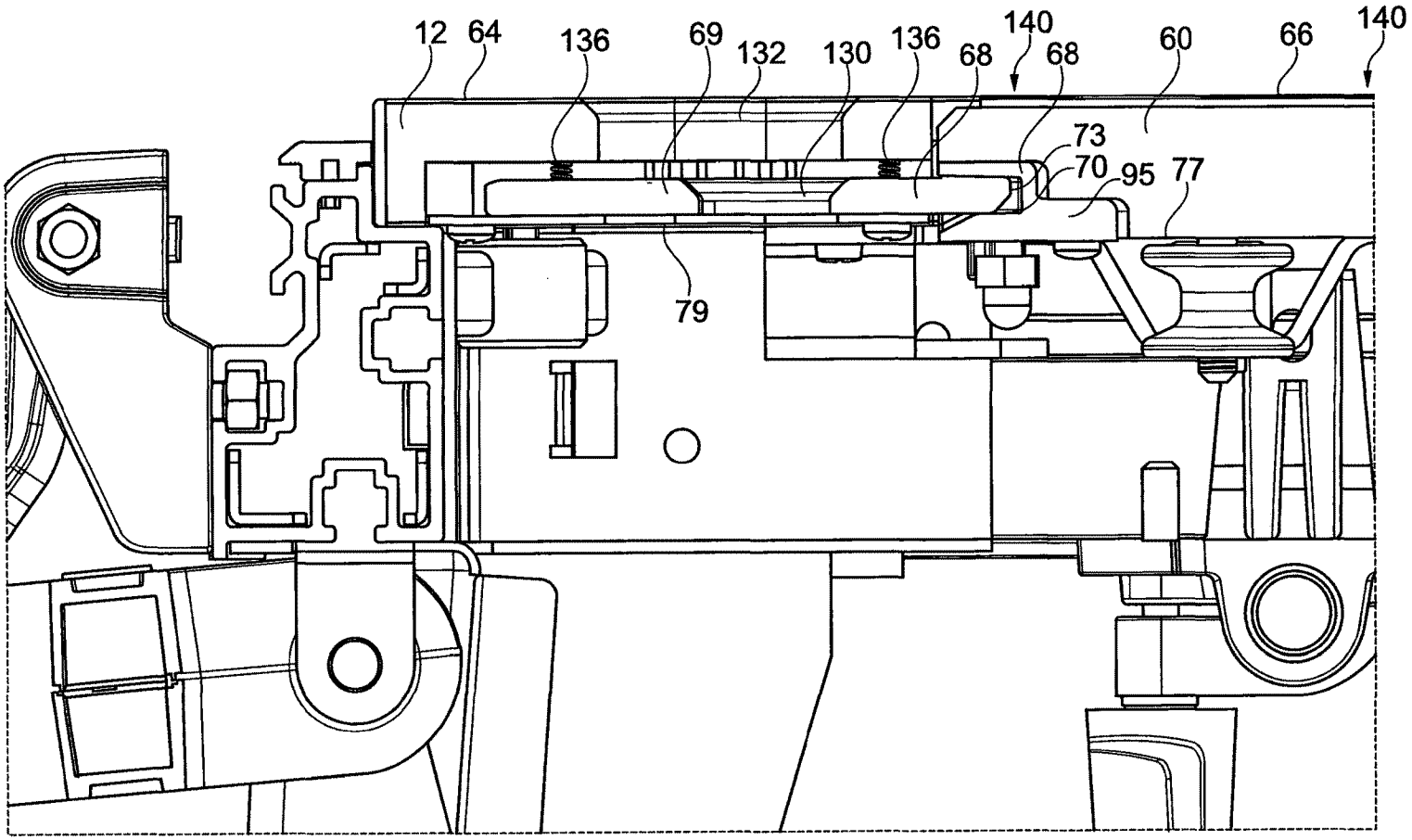

FIGS. 6*a-g* illustrate the frame with a number of modules located therewith;

FIGS. 7*a-c* illustrate engagement means in accordance with one embodiment of the invention;

FIGS. 8*a-e* illustrate guide means in accordance with one embodiment of the invention; and FIGS. 9*a-d* illustrate adjustment means in accordance with one embodiment of the invention.

Referring firstly to FIG. 1 there is shown power tool apparatus of a type which can be adapted and manipulated to perform a number of different functions. FIG. 1 illustrates one embodiment of the apparatus 2 in a first condition in which there is provided a plurality of legs 4,6,8,10 and a frame 12 supported by the same and which defines a central aperture 14 in this embodiment but which could equally be a slot or recess. The frame also includes a plurality of wheels 16 at end 18 and, at the opposing end 20, a handle 22. The ends of legs 4 and 10 can also be provided with wheels 30 to allow the location of the apparatus to be adjusted.

The legs are each provided to be pivotally movable about an axis 24 with respect to respective feet portions 4',6',8',10' so as to allow the legs to be folded towards the base and allow the same to take the form shown in FIGS. 2*a* and *b* in which the frame 12 can be supported above a support surface 26, such as a floor, and for the gap 28 between the frame underside and the support surface 26 to be sufficiently large so as to allow the apparatus to still be used in this arrangement. The folding of the legs also allows the apparatus to be wheeled along for transport purposes by the user gripping the handle 22 and rolling the same along the surface on wheels 16 as shown in FIGS. 3*a* and *b*. Thus, in accordance with the invention, the apparatus can be provided in a first condition shown in FIG. 1 for use and a second condition shown in FIGS. 2*a* and *b* for use. It can also be moved via rollers, castors, or wheels 30 in the first condition and via wheels, rollers or castors 16 in the second condition as shown in FIGS. 3*a* and *b*.

In either of the conditions the use of the apparatus can be selectively changed by the selective positioning of a module with respect to the frame 12 and in particular with respect to the aperture 14 defined by the frame.

The effective area of the work surface of the frame can also be adjusted as illustrated with reference to FIGS. 4*a* and *b*. In FIG. 4*a* the frame is illustrated as having a work surface defined by the end 18 and 20 and sides 32,34. The work surface includes guiderails 36, 38 to allow the selective engagement with components and the guided movement and positioning of the same and a fence 40 is provided as shown for the guided movement of a workpiece on which work is being performed by tools located on the apparatus at that time.

The frame can be adapted as shown with reference to FIG. 4*b*. This adaptation can be achieved by the provision of one or more side extensions 42,44 and/or one or more end extensions 46. It should be noted that although in FIG. 4*b* two side extensions 42,44 are shown it may be that only one is provided and that can be selectively positioned on either side of the frame. The side extension 42,44 is provided with members 48,50 which engage with guides on the underside of the frame 12 and which allow the controlled sliding movement as indicated by arrow 52 to and from the frame so as to effectively increase the useful working area of the frame by providing the means to support larger workpieces when work is being performed on the same. Similarly, the end extension 46 can be adjusted as indicated by arrow 54 via movement of the members 56, 58.

FIG. 5 illustrates the manner in which the aperture 14 can receive a module base 60 which is formed so as to allow a machine tool supported thereby to be used in conjunction with the frame. The base 60 is lowered into position as indicated by arrow 62 and preferably is initially lowered at one end and then pivotally moved into position in a manner which will subsequently be described. The location of the base with respect to the frame has to be ensured to be secure so that the module effectively becomes an integral part of the apparatus when located therewith. Furthermore, it is normally important and is desired that the top surface 64 of the base 60 is substantially flush with the top surface 66 of the frame 12 so as to form in combination, a substantially integral and uniform work surface so that accurate machining operations can be performed. In one embodiment this is achieved by providing on each of the modules one, but typically a plurality, of adjustment means 61 described in more detail subsequently.

Referring now to FIGS. 7*a-c* there are illustrated views of engagement means in accordance with the invention and which are provided in order to releasably engage the base 60 of a module in position with the frame 12. FIG. 7*a* illustrates a plan view of part of the base and frame in position and shows the respective top surfaces 64, 66 of the frame and base held in position by mechanical engagement means 68,68', one of which, engagement means 68, is now described in detail. FIGS. 7*b* and *c* illustrate a cross section elevation along line AA and which show the engagement means in two positions. The engagement means are provided, typically at opposing ends of the base and on the frame, which allow the mechanical engagement. The engagement means 68 comprises an aperture 130 provided in the part 69 which is accessible via an aperture 132 provided in the frame and through which a person can place their finger in the direction of arrow 134 to engage the part 69. The part 69 is mounted in the frame to be slidingly movable in the direction of arrow 75 between a release position in which the part is substantially wholly located within the frame 12, and an engaging position shown in FIG. 7*c* in which the leading edge 73 of the part 69 moves into an aperture 70 provided in part 95 mounted on the underside 77 of the base. The leading edge 73 of the part 69 is preferably tapered as shown and the part 69 is biased towards the underside 79 of the frame by one or more springs 136 mounted in the aperture 138 in the frame 12 in which the part 69 is located and which act on the part 69 so that when the part 69 is located in the aperture 70 in the engaging position shown in FIG. 7*c* the effect of the tapered leading edge 73, the ramp portion 138 of the aperture 70 and the biasing means springs 136 is transferred to the module base 60 which is effectively pushed down as indicated by arrows 140 by the bias force to ensure good contact of the adjustment means and hence ensure that the base is retained in the desired position with respect to the frame. This ensures that the position of the module base 60 is maintained during use of the machining by the power tool located on the base and acts against any movement forces which may be exerted by the same.

Figure 8A:
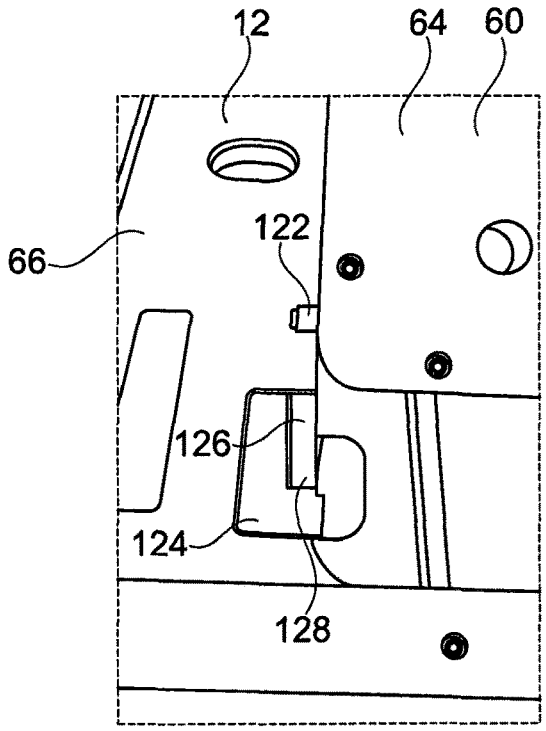
Figure 8B:
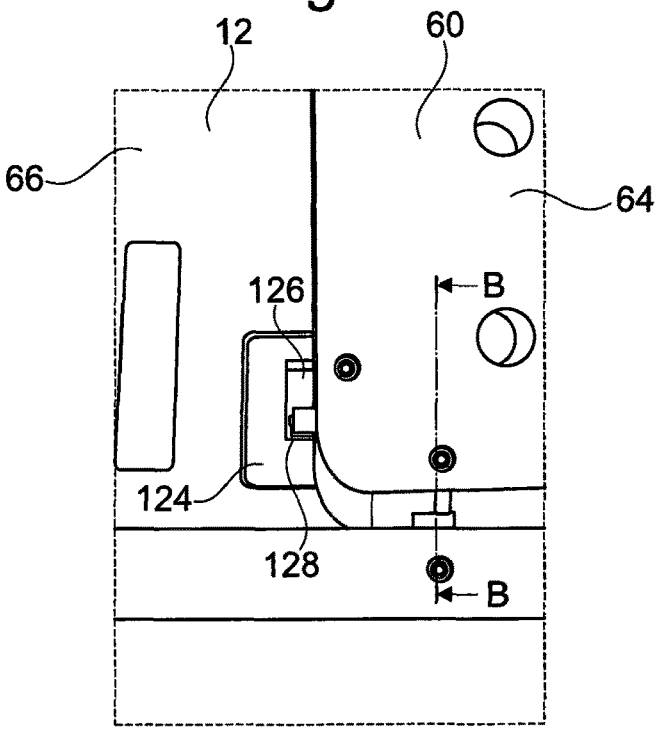
Figure 8C:
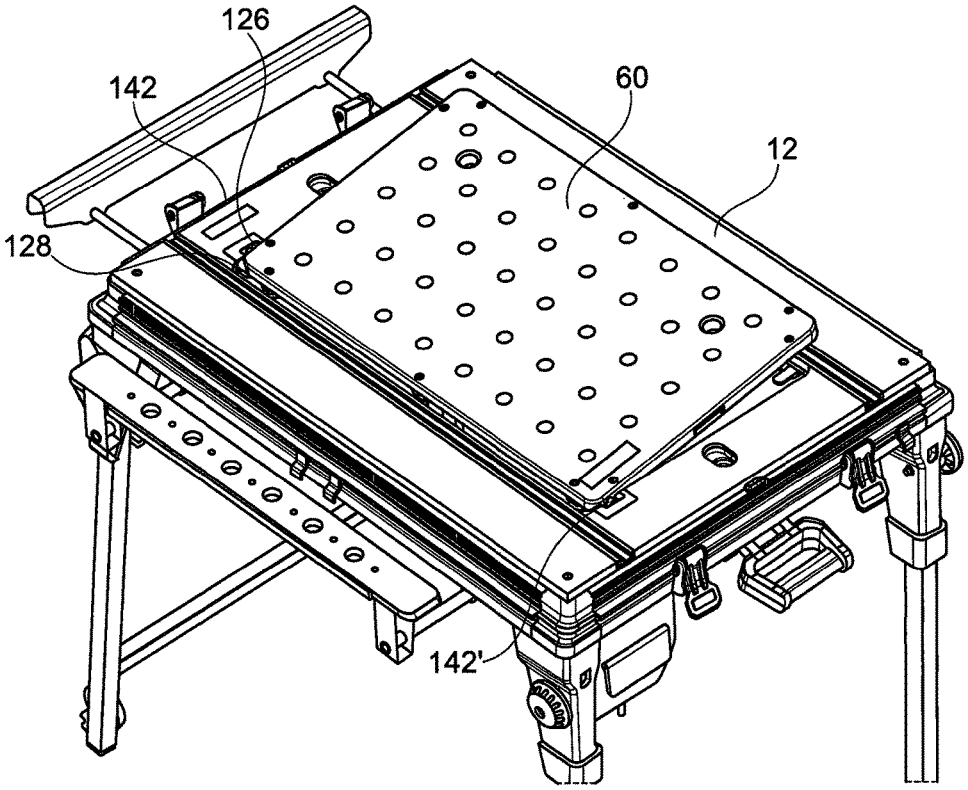
Figure 8D:
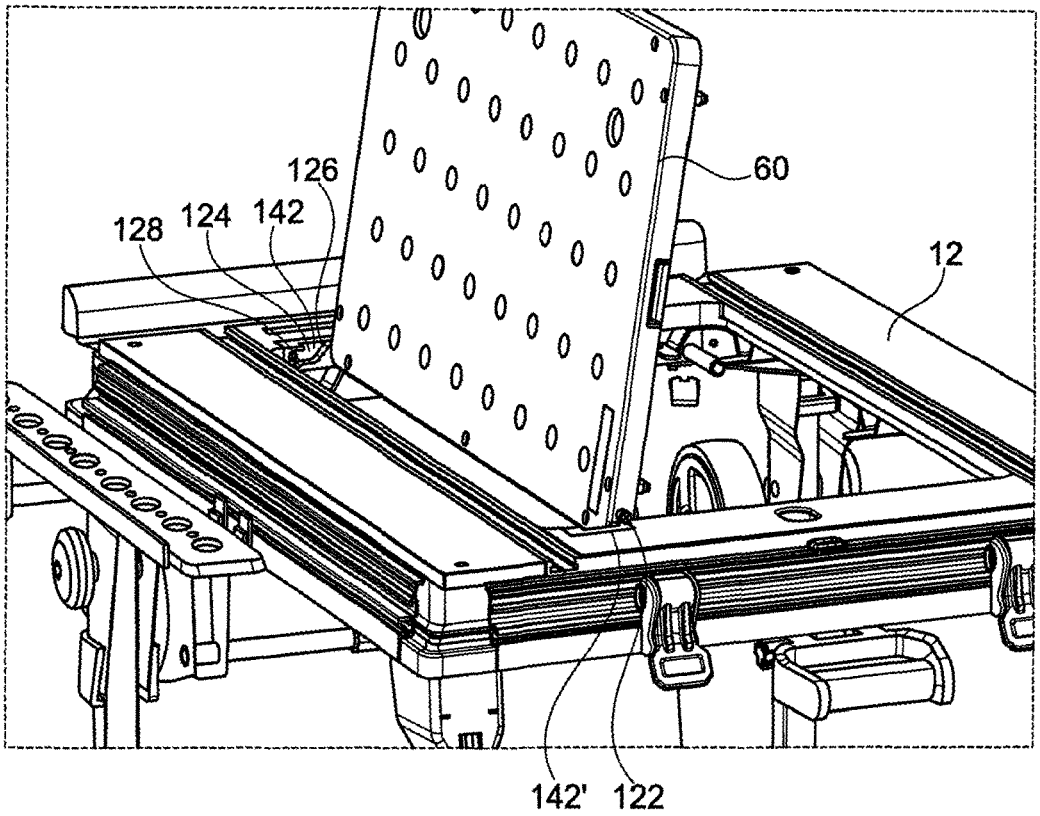
Figure 8E:
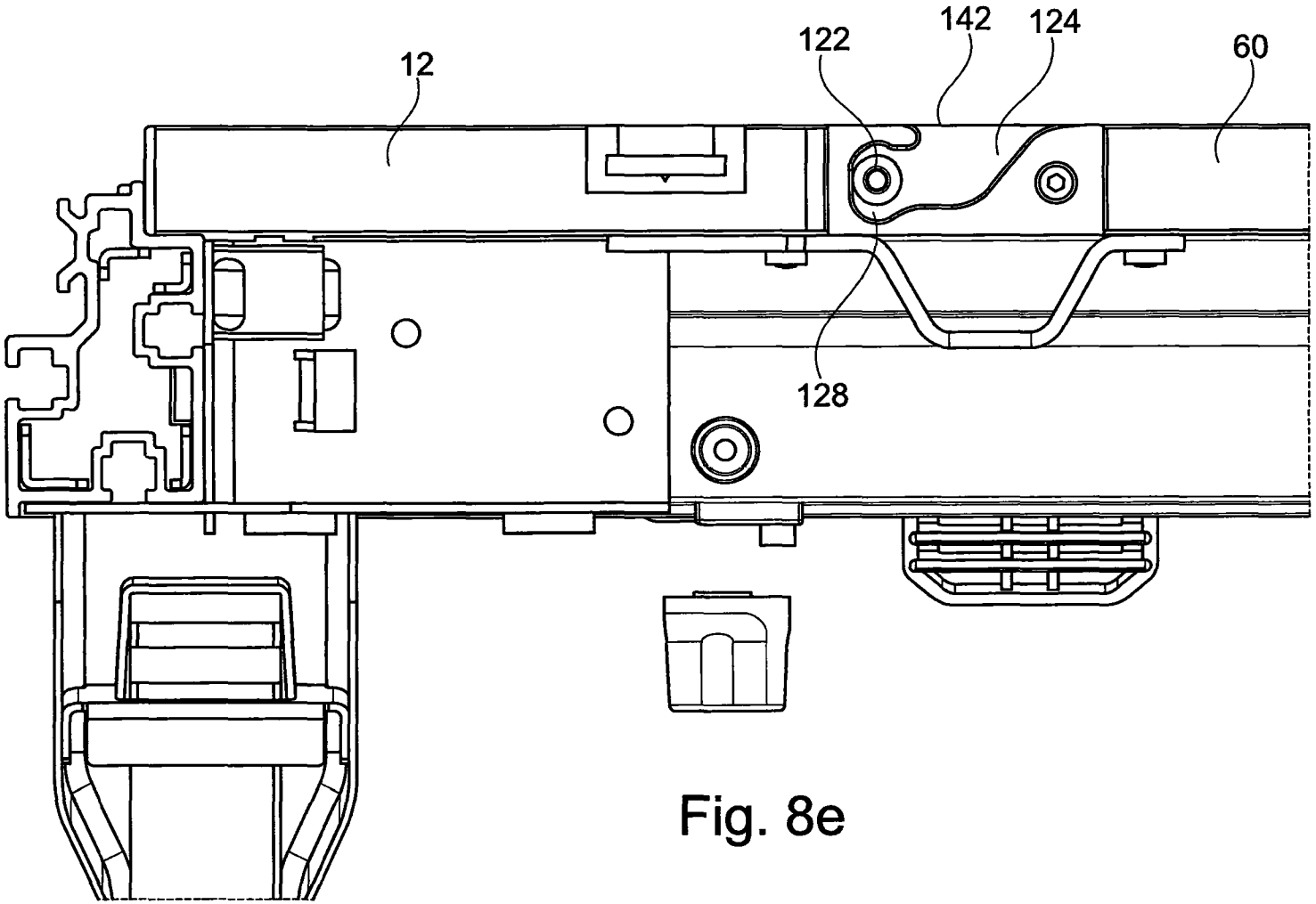

The guide means for the base and frame are shown in more detail in FIGS. 8*a-e*. The guide means 142,142' are provided at or towards one end of the base and aperture in the frame and on either side thereof as shown in FIGS. 8*c* and *d* and are provided to aid in the movement of the base 60 into and from an engaged position in the aperture in the frame 12. In FIG. 8*c* the base 60 is shown having been almost moved into position with regard to the frame and in FIG. 8*d* the base 60 is shown in a position prior to being moved into engagement with the frame or having been moved out of engagement with the frame. One of the two guide means is shown in detail in FIGS. 8*a* and *b* and includes a member 122 which acts as a roller or slide and which protrudes from the edge of the base 60 and is received in a ramp portion 124 located at the edge of the frame as shown. In order to introduce the module base 60 into the aperture, the base is moved at an angle to the frame aperture such that the member 122 for each of the respective guide means lies at the top 126 of the ramp portion and contacts with the same. The base is then slid and pivoted downwardly, with the guide means in contact, so that the member 122 moves to the bottom 128 of the ramp portion as shown in FIG. 8*b* and therefore provides the base in the required position in the aperture of the frame. FIG. 8*e* illustrates one of the guide means 142 with portions of the base and frame removed in order to show the member 122 of the base in a final position to locate the base with the frame 12, with the member 122 located at the bottom 128 of the ramp portion 124.

Figure 9A:
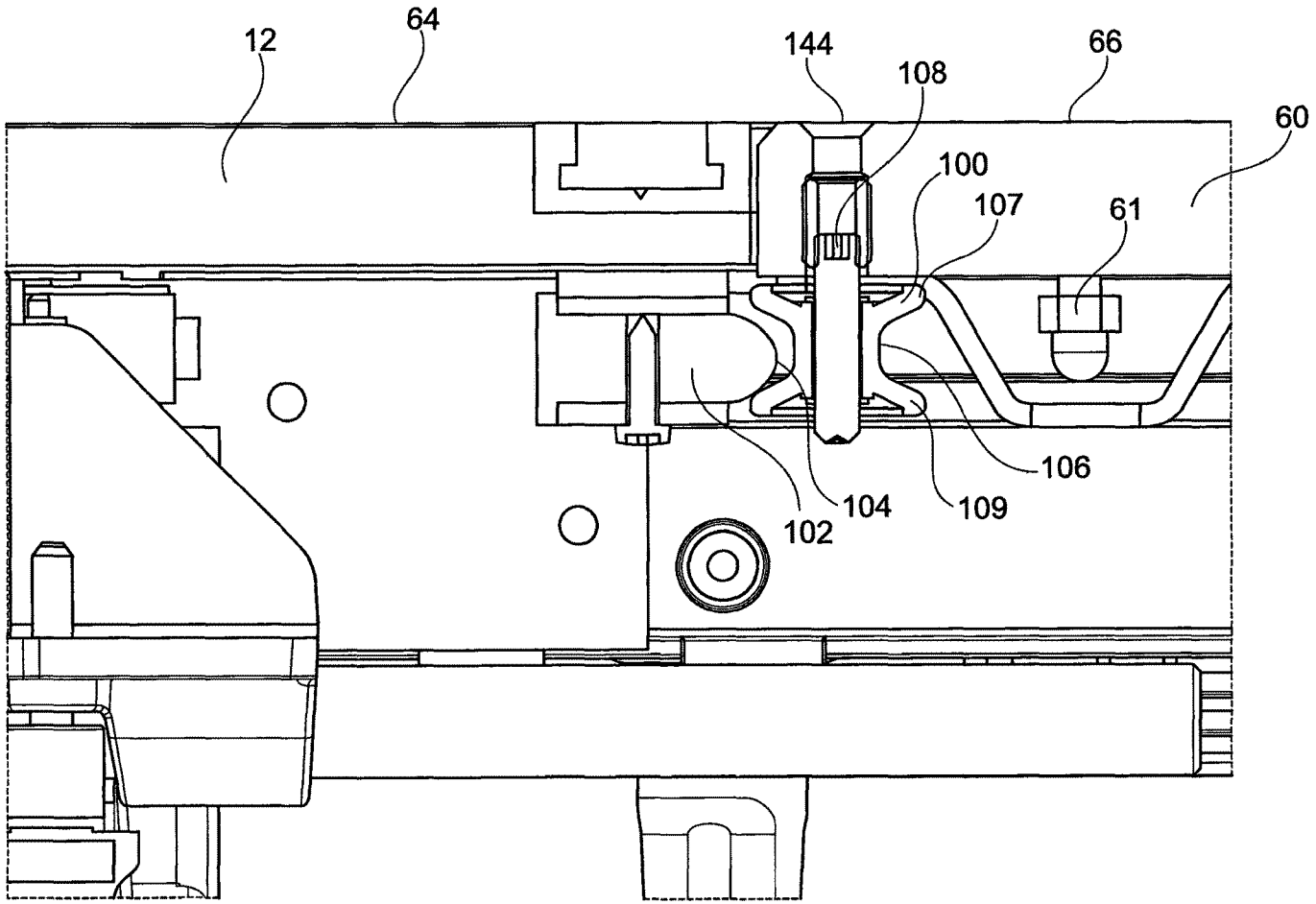
Figure 9B:
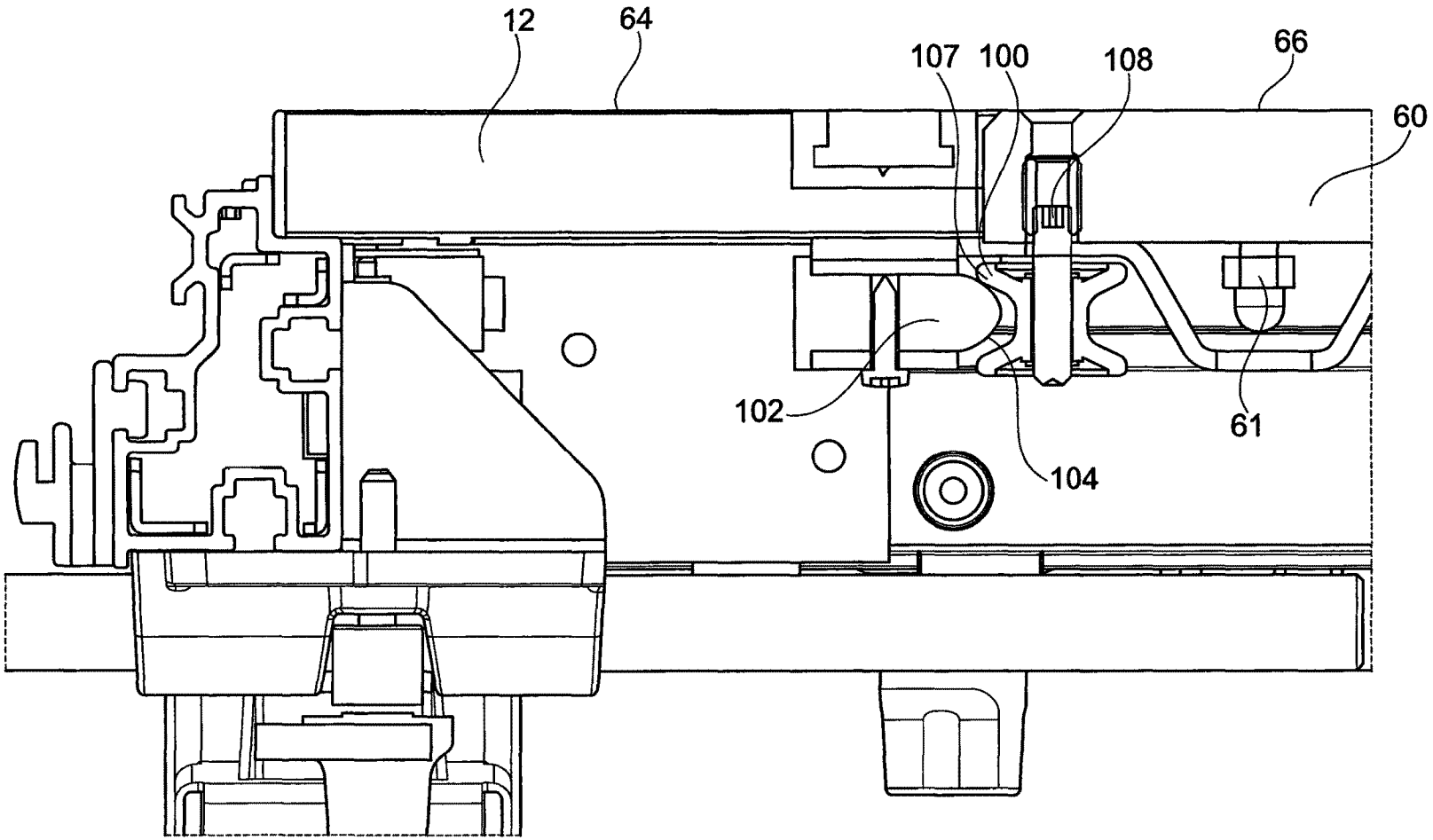
Figure 9C:
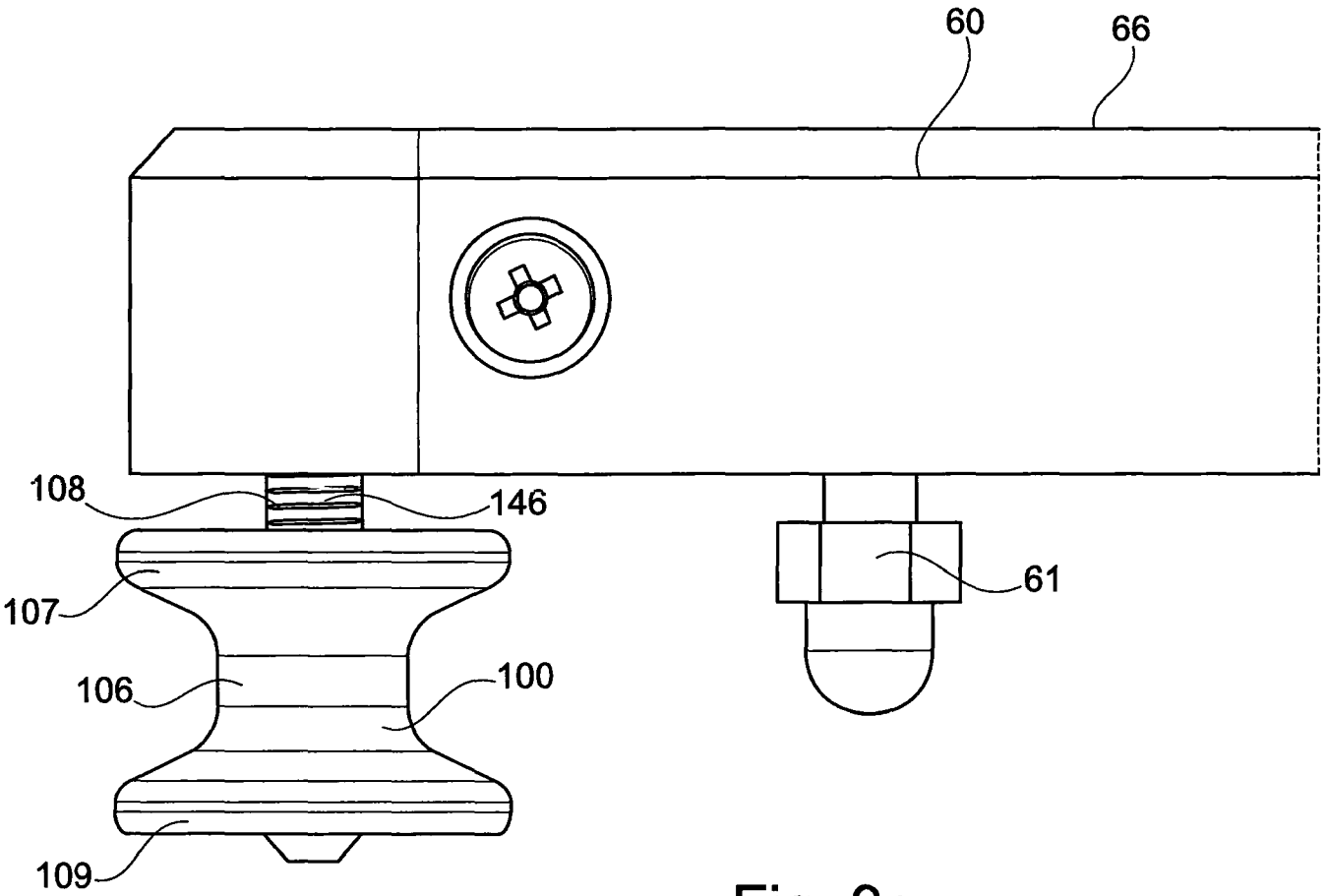

When in position, the level of the top surface 66 of the base 60 can then be adjusted with respect to the frame 12 top surface 64 by the use of adjustment means, which, in one embodiment includes at least first and second sets of adjustment means and further adjustment means. Typically a first set of adjustment means are located adjacent a first of the guide means 142 and a second set of adjustment means are located adjacent a second of the guide means 142' and act to aid in the guiding of the module base 60 into and from the recess slot or aperture in the frame aperture as well as then allowing adjustment of the level of the base with respect to the frame. One of the sets of adjustment means is shown in more detail in FIGS. 9*a* and *b* which are cross sectional elevations along line BB which shows the adjustment means set in differing positions and FIG. 9*c* shows part of the set of adjustment means which is mounted on the base along with one of the further adjustment means located on the base 60.

The aim of the use of the adjustment means is normally to move the top surface 66 of the base into line with the top surface 64 of the frame 12. The adjustment means in the set comprise a first "bobbin" shaped member 100 on the underside of the base and a shaped member 102 which protrudes from the underside of the frame and the face 104 of the same is shaped so as to engage within the central portion 106 of the bobbin 100 which is defined by upper rim 107 and lower rim 109. User actuation means 108 in the form of a threaded shaft pass through the centre of the bobbin and are actuable by a user from the top surface aperture 144 on the base. These adjustment means allow positive adjustment of the base with respect to the frame to raise and lower the same with use of the actuation means 108. There is a sufficient gap 146 between the bobbin and the underside of the base such that rotation of the actuation means in a first direction causes the upper rim 107 to contact the face 104 to provide a pushing force against the same and move the base in a first direction with respect to the frame as shown in FIG. 9*b* and rotation of the member 108 in the opposite direction causes contact of the lower rim 109 of the bobbin 100 with the member face 104 to cause a pulling force against the same and move the base in a second, opposing, direction with respect to the frame and allow the adjustment of the position of the top surface of the base with respect to the frame. Thus the provision of the adjustment means sets ensures that positive adjustment of the base with respect to the frame can be achieved in both directions at the location of the guide means along axis 111 whilst, at the same time ensuring that there is sufficient freedom to allow the guide means to function.

Figure 9D:
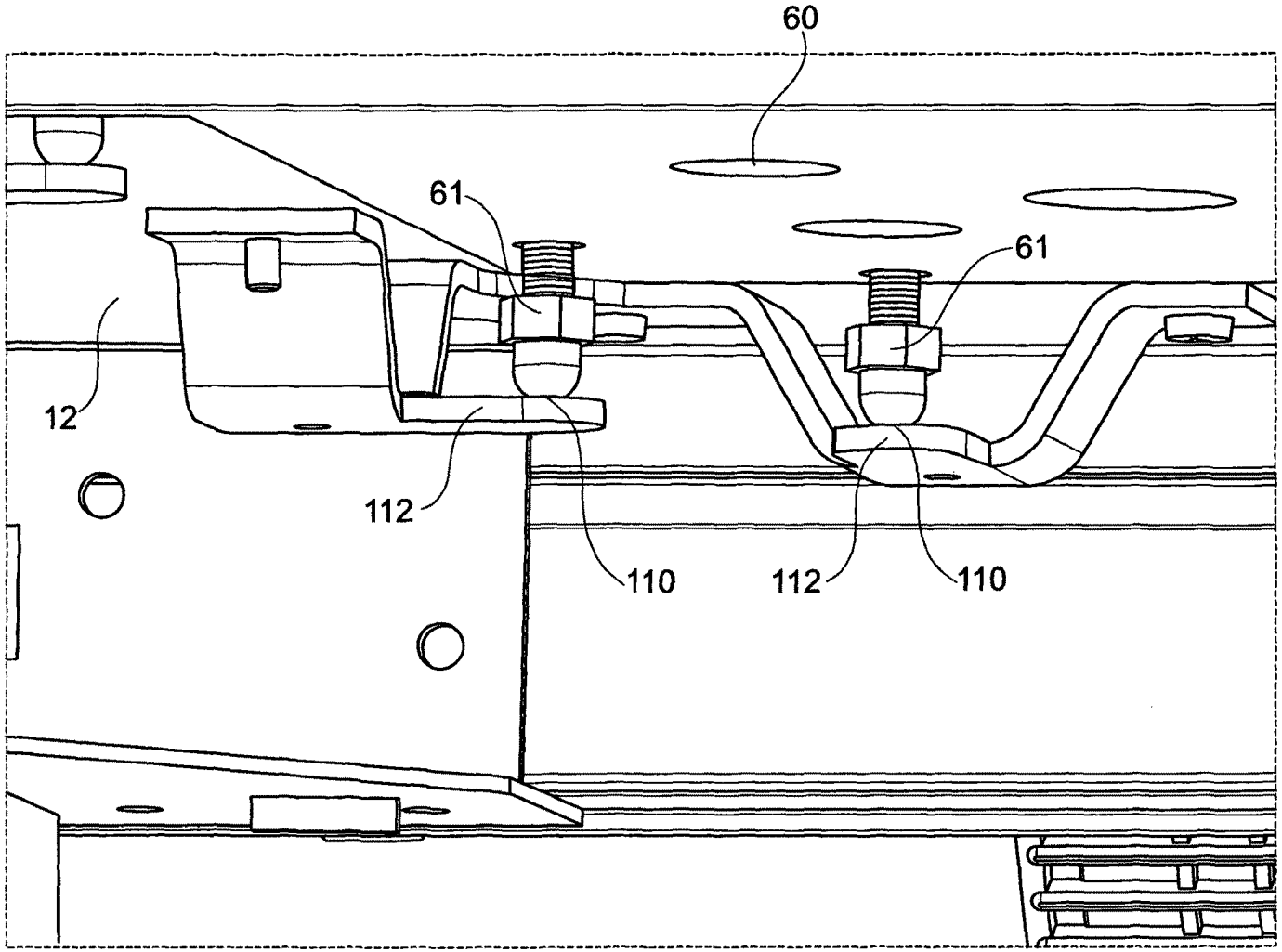

At other spaced locations around the periphery of the frame further adjustment means in the form of threaded shafts such as grub screws 61 are provided and preferably ten adjustment points are provided in total around the base and frame. Two of the threaded shaft adjustment means 61 are illustrated in FIG. 9*d*. The grub screw has a free end 110 which depends downwardly from the underside of the module base 60 and which engages with a support plate 112 mounted in a fixed position on the frame 12 and extending from the frame. Thus, when the module base is in position, the user can adjust, from the top surface of the base, the length by which each of the screws 61 depend downwardly from the underside of the base so the user can effectively adjust and determine the level of the top surface 66 of the base with respect to the top surface 64 of the frame for each module base independently. The extent to which these adjustment means, such as grub screws, extend from the base can be altered until typically, the top surface 66 of the base is flush with the top surface 64 of the frame. This means that in subsequent use the adjustment means need not be altered again as long as the contact between the adjustment means and the frame is clean. As the adjustment means are provided on the module so each module can be adjusted to provide the required flush surface and so there is no need for the adjustment of the frame structure to be performed.

The apparatus therefore allows a number of different modules to be used in conjunction therewith for different machining operations to be performed on workpieces. As, in each case, the module has a base which is of the same size and which can be received in the same manner in the aperture 14 so the apparatus is extremely flexible in terms of its use. In one embodiment the module can be formed solely by the base and in this arrangement the base may have a plurality of apertures, slots and/or engagement means to allow clamping, holding and guiding means to be selectively positioned thereon.

Figure 6A:
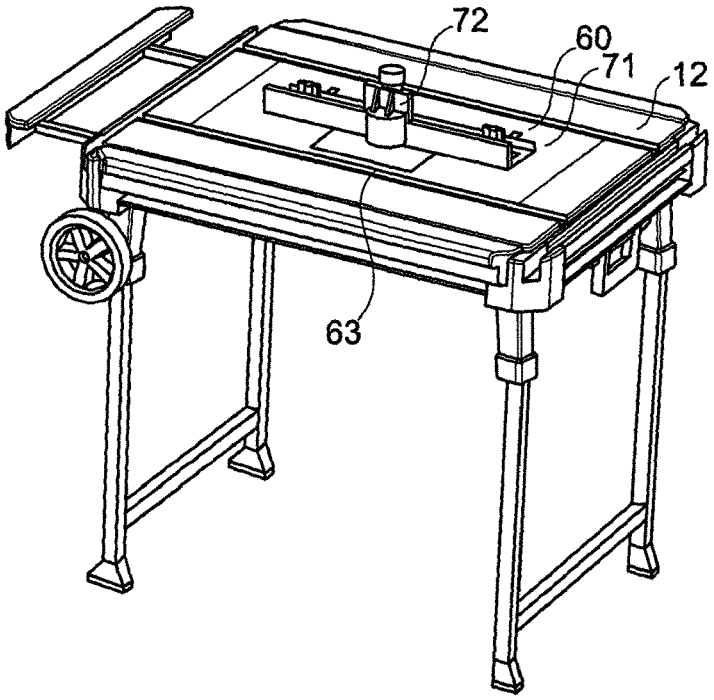
Figure 6B:
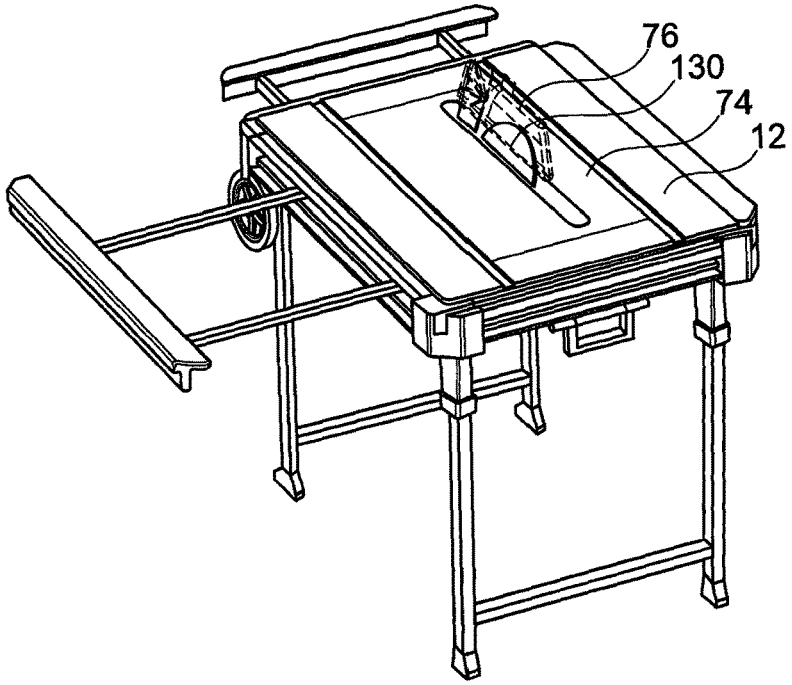
Figure 6C:
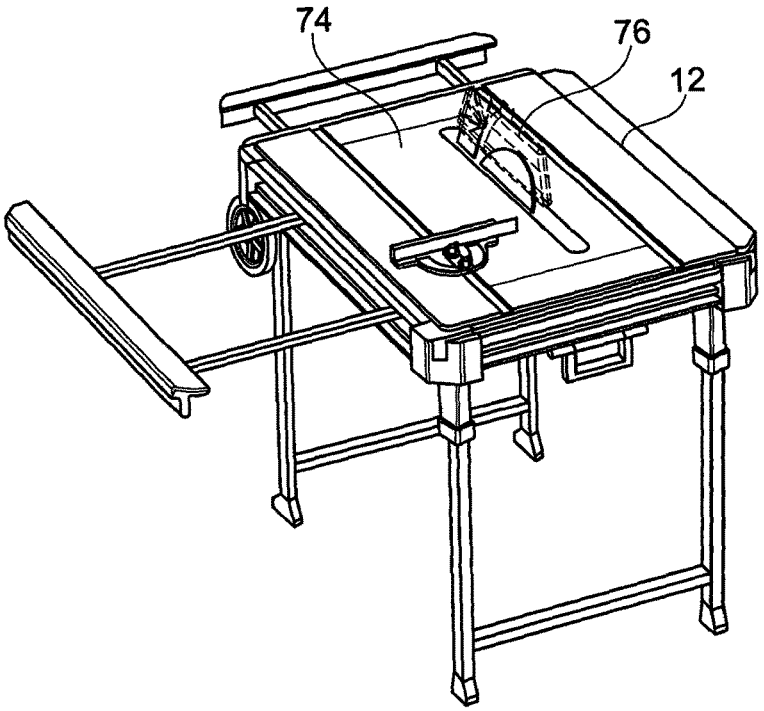
Figure 6D:
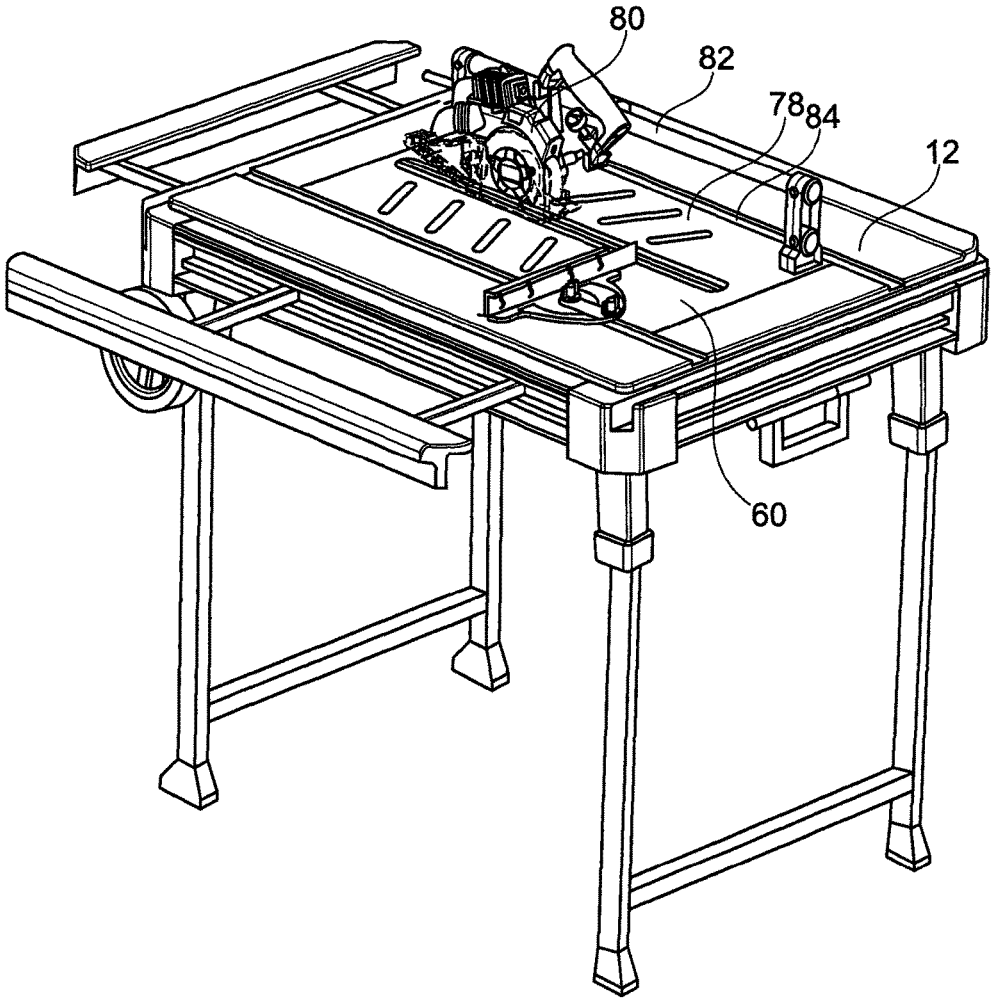
Figure 6E:
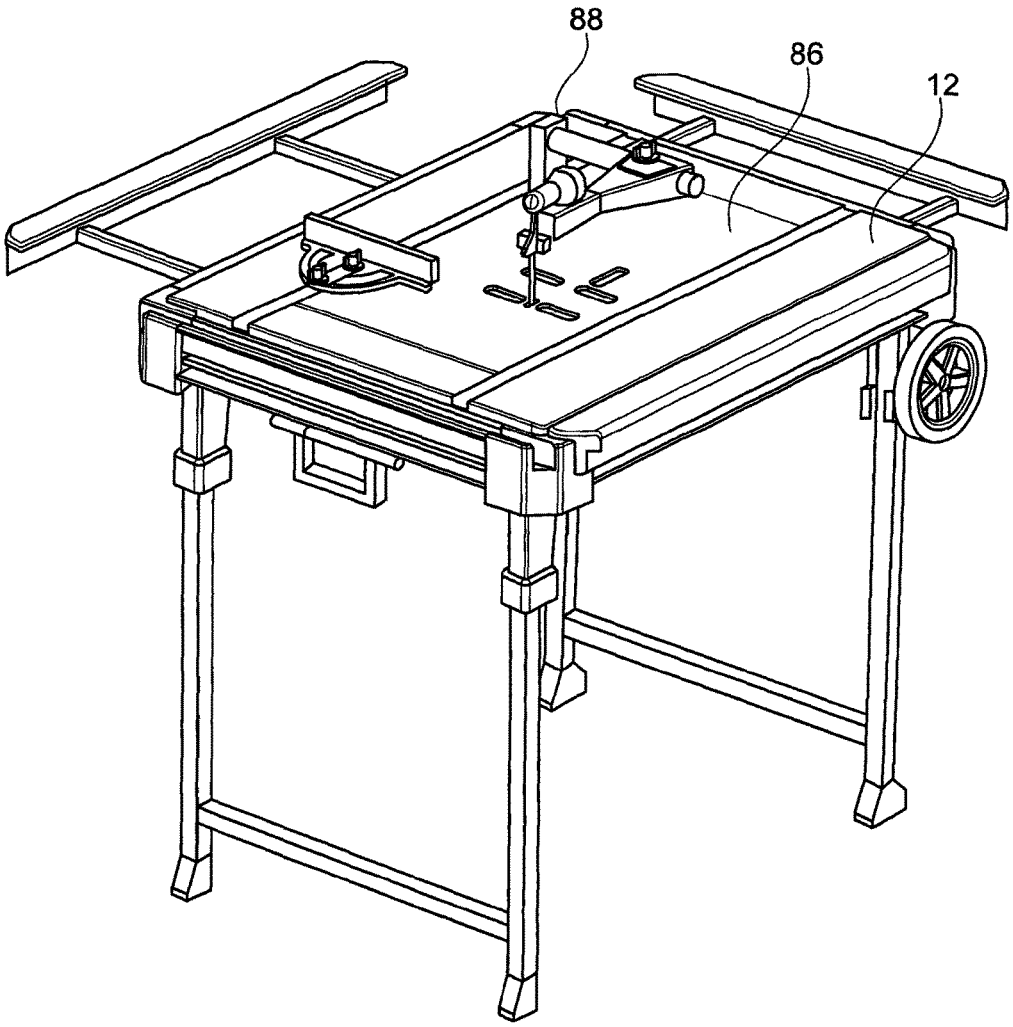
Figure 6F:
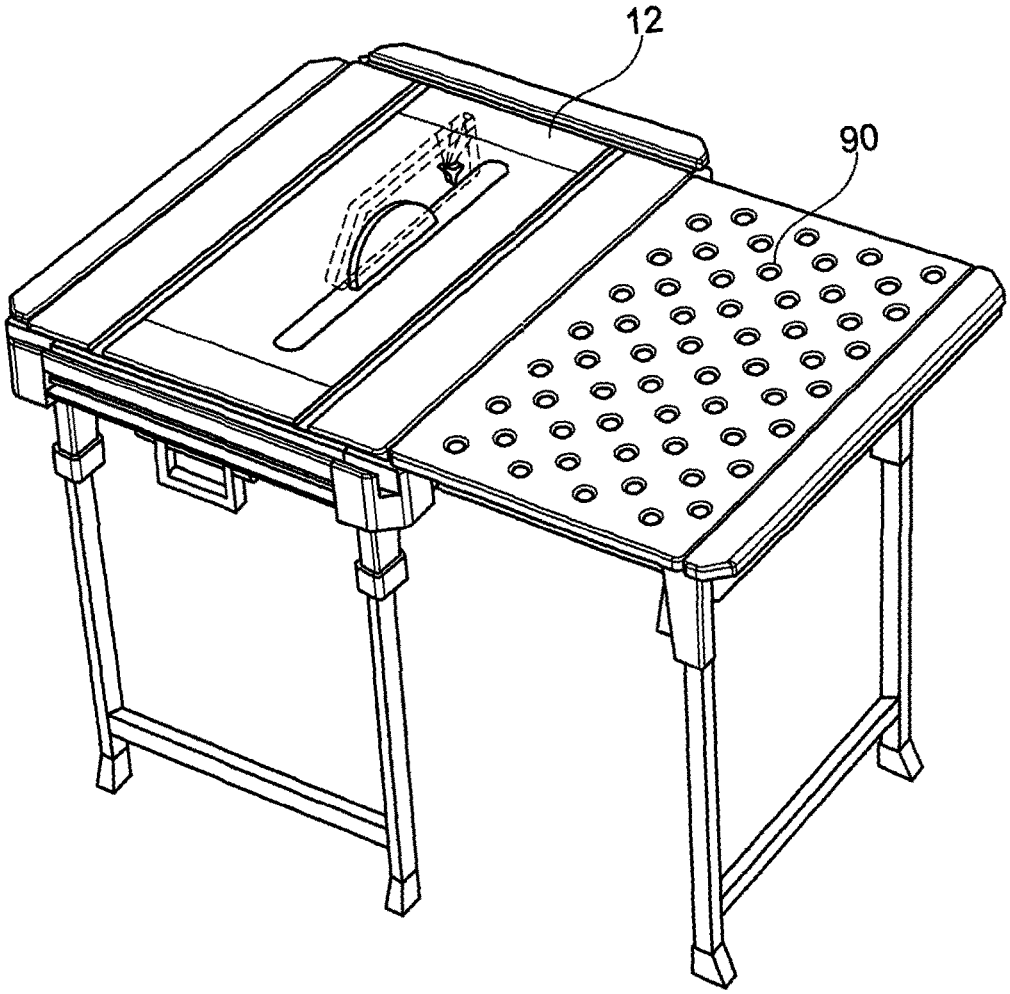
Figure 6G:
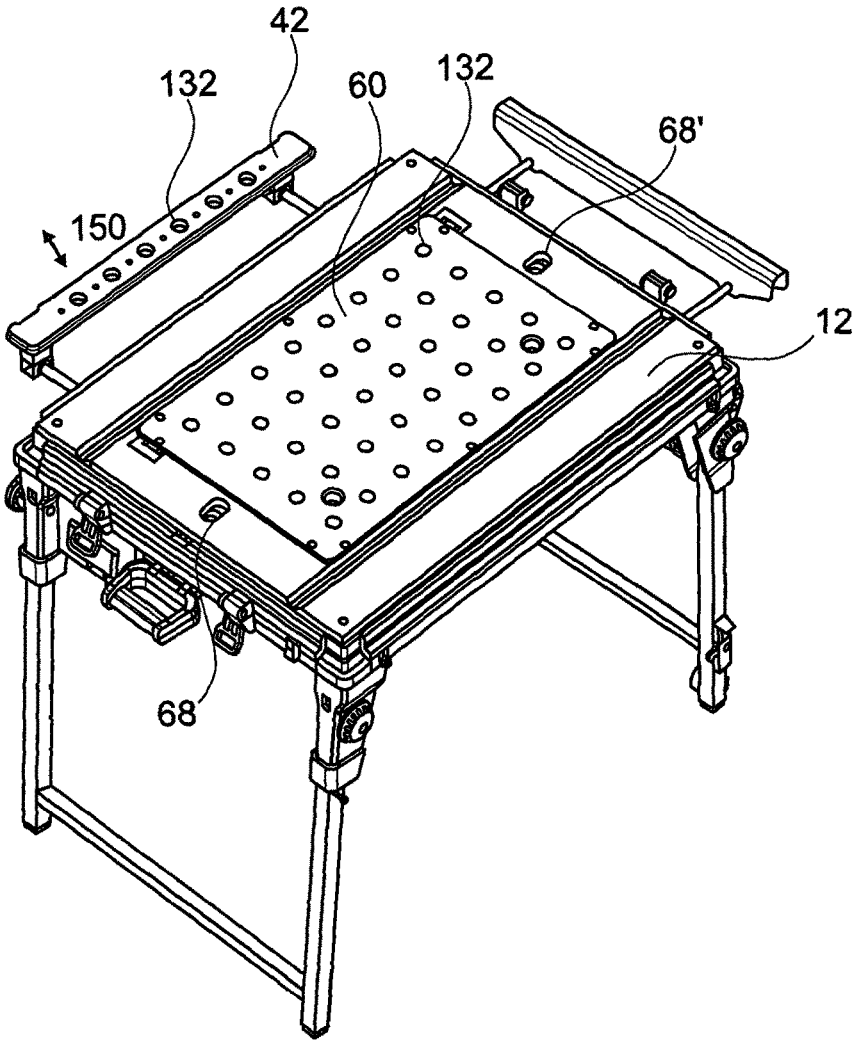

FIG. 6*a* illustrates the apparatus being used with a module 71 which allows a router 72 to be used. The main part of the router is located underneath the base and the working portion depends upwardly from the top surface of the base. In this case there is a need to be able to adjust parameters of the router body such as to adjust the height of the same and/or engage the spindle lock on the router but these control means are located on the underside of the module base. In accordance with the invention the control means can be engaged from the top surface of the module base 60 as the fitting of the router power tool is aligned with an aperture 63 provided in the module base which allows the fitting of a tool to the adjustment means which can be accessed from the top surface of the base. FIGS. 6*b* and *c* show the module 74 being used with a circular saw 76 and in this case it is possible for the height of the module base 60 to be adjusted with respect to the frame by the user adjusting an adjustment screw (not shown) located to be accessible at the top surface of the base and which passes down to the underside of the base and thereby allow operation of a scissor hinge arrangement mounted on the frame and acting on the module base so as to allow the height of the base to be adjusted with respect to the frame to thereby adjust the height of the protrusion of the cutting blade 130 with respect to the frame to surface. FIG. 6*d* shows a module 78 being used in which there is provided a circular saw 80 mounted on slide members 82,84 and which, most typically can be used to saw through relatively thin workpieces such as flooring panels in differing modes of operation. Furthermore, in this arrangement the module can be used independently of the remainder of the apparatus without the requirement of adaptation as the module is provided with feet (not shown) which protrude from below the module base 60. FIG. 6*e* illustrates a frame 12 with a module 86 with a band saw 88 machining tool mounted thereon. FIG. 6*f* illustrates the frame 12 with a further support table 90 provided. In this embodiment it will be seen that the support table 90 includes a plurality of location apertures 132 thereon for the user placing of tools, components and or fixtures in selected positions using clamping means of a conventional form. In one embodiment the module may comprise a base with a similar plurality of location apertures formed thereon as shown in FIG. 6*g*. In this case therefore the module base does not have a tool fixed thereto when placed into the frame but may receive a tool thereon subsequently. In addition, a frame portion 42 can include a series of location apertures therein also and, as the same can be moved relative to the remainder of the frame to extend the effective work surface of the apparatus as indicated by arrow 150, then the need for the additional table 90 shown in FIG. 6*f* is removed.

There is therefore provided apparatus which can be used to receive a plurality of modules and thereby allow the apparatus to be used to advantage in the operation of the power tools mounted on said modules.

The invention claimed is:

1. Apparatus for use with one or more types of power tool to perform a power tool operation on a workpiece, said apparatus comprising:

a frame defining a slot, recess or aperture;

a plurality of modules, each module including a base carrying at least one power tool thereon, said base is lowered into said slot, recess or aperture and engaged with the frame to secure the module in position to thereby form, in combination, a work surface on which the workpiece is positioned during the operation of the power tool;

at least one adjustment mechanism that adjusts the position of a top surface of the base of the module with respect to a top surface of the frame, said adjustment mechanism comprises a first member provided on said base, a second member located on the frame and engaging with the first member and an actuator having an actuation position that displaces said first member with respect to said second member such that the top surface of the base of the module is flush with the top surface of the frame, and wherein the said first member is bobbin shaped and has a central portion, an upper rim and a lower rim, the second member is shaped so as to engage with the central portion of the said first member and the actuator is a shaft which is threaded and passes through the center of the first member.

2. Apparatus according to claim 1 wherein the apparatus includes engagement means to lock the module in position with the frame.

3. Apparatus according to claim 2 wherein the engagement means includes a first portion located on the frame and a second portion located on the base.

4. Apparatus according to claim 3 wherein the first portion includes a part which is movable between an engaging position in which said part protrudes into contact with the second portion and a release position.

5. Apparatus according to claim 4 wherein said part is biased towards a lower surface of the frame.

6. Apparatus according to claim 5 wherein said part, when in the engaging position acts to bias the module base downwardly to retain contact between the at least one adjustment mechanism provided on the base and frame.

7. Apparatus according to claim 4 wherein said part can be latched in both of the engaging and release positions.

8. Apparatus according to claim 4 wherein said part can be latched in either of the engaging or release positions.

9. Apparatus according to claim 1 wherein the at least one adjustment mechanism, once set after initial alteration, are retained in the adjusted position such that when the module is thereafter placed into position, the level of the top surface of the module base with respect to the level of the frame top surface is at the same position as when adjustment was initially performed.

10. Apparatus according to claim 1 wherein the adjustment made is to bring the top surface of the base of the module substantially in line with the top surface of the frame so as to form a substantially uniform work surface.

11. Apparatus according to claim 1 wherein the at least one adjustment mechanism is provided at spaced locations on the module base and are movable with respect to an adjacent portion of the frame to allow relative adjustment at each said location.

12. Apparatus according to claim 1 wherein the at least one adjustment mechanism is actuable by a user from the top surface of the base of the module.

13. Apparatus according to claim 1 wherein the at least one adjustment mechanism comprises a plurality of sets of adjustment mechanisms which are spaced apart and which assist in guiding the movement of the position of the base into and from the frame.

14. Apparatus according to claim 1 wherein the at least one adjustment mechanism includes a series of user actuators each of which contact with a support means extending from the frame and which causes the base and hence the level of the top surface of the base to be adjusted with respect to the frame.

15. Apparatus according to claim 1 further comprising guide means located at, or adjacent to, one end of the module and on opposing sides thereof to allow the guided introduction and removal of the module into and from the slot, recess or aperture in the frame.

16. Apparatus according to claim 15 wherein the guide means comprise a protruding member provided on one of the base and frame and a shaped ramp portion provided on the other of the base or frame and along which the protruding member moves.

17. Apparatus according to claim 16, wherein said member comprises a roller or slide protruding from an edge of the base or frame on which the member is located.

18. Apparatus according to claim 15, wherein the guide means are provided to permit guided sliding and subsequent pivoting movement of the module with respect to the frame to introduce the module into the slot, recess or aperture in the frame.

19. Apparatus according to claim 15, wherein the guide means are located at, or adjacent to, the end of the module at which said at least one adjustment mechanism are located.

20. Apparatus according to claim 15, wherein after said guided introduction, the level of the top surface of the base can then be adjusted with respect to the top surface of the frame by said at least one adjustment mechanism.

21. Apparatus according to claim 1 wherein at least one of the modules of the plurality of modules is provided such that the at least one of the modules of the plurality of modules can be used independently of the frame of the apparatus.

22. Apparatus according to claim 1 wherein the frame is provided with at least one portion which is selectively movable to a position within a range of positions to a side of the frame in order to allow the selective increase or decrease of an effective area of the work surface of the frame.

23. Apparatus according to claim 1 wherein the frame includes a plurality of support legs, said support legs, in a first extended position holding the top surface of the frame at a first distance from a support surface on which the legs are located and, in a second position in which at least a portion of the legs are folded or retracted such that said top surface is positioned at a reduced distance from the support surface and in which second position the apparatus can be transported.

24. Apparatus according to claim 1 wherein the frame includes a first set of wheels, castors or rollers which allow movement of the apparatus in a first form and a second set of wheels, castors or rollers which allow movement of the apparatus in a second form.

25. Apparatus according to claim 1 wherein the frame includes one or more guiderails to allow the selective engagement of one or more components to be used with the apparatus and the guided movement and positioning of the same.

26. Apparatus according to claim 1 wherein adjustment of the power tool with respect to the module base is made via one or more apertures provided in the base by a user from the top surface of the base.

* * * * *